US005307771A

United States Patent [19]

Stahel, II et al.

[11] Patent Number: 5,307,771

[45] Date of Patent: May 3, 1994

[54] MOTORCYCLE AIR CLEANER

[75] Inventors: Alwin J. Stahel, II, St. Paul, Minn.; Thomas H. Rudd, Hudson, Wis.; Brian K. Stahel, New Brighton, Minn.

[73] Assignee: KuryAkyn Holdings, Inc., Hudson, Wis.

[21] Appl. No.: 843,990

[22] Filed: Feb. 28, 1992

[51] Int. Cl.[5] ..... F02B 77/00

[52] U.S. Cl. ..... 123/198 E

[58] Field of Search ..... 123/198 E, 389, 442

[56] References Cited

U.S. PATENT DOCUMENTS 4,008,700 2/1977 Pierlot ..... 123/442

OTHER PUBLICATIONS

Specialty Parts & Accessories, Fall/Winter 1991, p. 353, The Street Scoop II.

Specialty Parts & Accessories, Spring 1992, p. 339, All Cast Aluminum Competition Air Scoop.

The Harley Davidson Motor Co. 1992 Genuine Accessories Catalog, pp. 81 and 119.

Drag Specialties, Feb. 1992, pp. 81, 82 and 462, The Personal Touch.

American Motorcycles, , pp. 165-166, Chrome Specialties 1991/1992.

*Primary Examiner*—Noah P. Kamen

*Attorney, Agent, or Firm*—Kinney & Lange

[57] ABSTRACT

An intake assembly of the present invention delivers air to a carburetor of an internal combustion engine. The assembly includes a housing mountable on the carburetor and which encloses an air filter. A first port is formed within a wall of the housing to permit fluid communication between the housing and the carburetor. The first port is positioned between the air filter and the carburetor. A second port is formed in a wall of the housing to permit air to enter the housing. The second port is positioned relative to the air filter on a side opposite from the first port. A valve assembly is pivotably mounted within the second port such that the valve assembly is positionable to control an air flow through the second port. Means are provided for controlling the pivoting of the valve assembly.

26 Claims, 6 Drawing Sheets

MOTORCYCLE AIR CLEANER

BACKGROUND OF THE INVENTION

The present invention relates to internal combustion engines. In particular, the present invention relates to an air intake system for an internal combustion engine.

Internal combustion engines operate by creating a controlled combustion of a mixture of fuel and air within a cylinder of the engine. Ultimately the energy produced by this combustion is transmitted to a drive shaft or other means for providing a locomotive force to gear or wheel.

To create this combustion within the cylinder, air must be taken from outside the engine and combined with fuel to create an inflammable gas mixture. A carburetor typically performs this task. The carburetor selectively guides the flow of air and fuel into a main conduit of the carburetor where the air and fuel are mixed into the inflammable gas. This gas mixture is then delivered to a cylinder of the engine for combustion therein.

The air intake system for a carburetor typically has an air filter positioned outside of the main conduit. This air filter removes undesirable particles, such as dirt and oil, from the air as the air is passing from the outside environment into the carburetor. The air filter is encompassed within a housing which covers the air filter and directs the flow of air into and through the air filter. Once the air passes through the air filter, it passes down into a mouth of the carburetor.

The horsepower produced by an engine is limited in part as a function of the air-fuel mixture ratio. One way of increasing the horsepower of the engine is by providing a greater amount of air available for mixing with the fuel. However, the air must be provided to the carburetor without over pressurizing the carburetor float bowl which would impede engine performance. Some known methods of increasing the horsepower of an engine by augmenting the air that enters the carburetor include supercharging and turbocharging.

The amount of air entering the carburetor is typically limited by the fixed configuration of the intake openings in the air filter housing. These openings are sized and positioned to direct an adequate amount of air through the air filter and into the carburetor without over pressurizing the carburetor float bowl. The housings usually do not provide a means for selectively closing the openings or selectively varying the amount of air permitted to flow through the housing (and ultimately the carburetor).

SUMMARY OF THE INVENTION

An intake assembly of the present invention delivers air to a carburetor of an internal combustion engine. The assembly includes a housing mountable on the carburetor and which encloses an air filter. A first port is formed within a wall of the housing to permit fluid communication between the housing and the carburetor. The first port is positioned between the air filter and the carburetor. A second port is formed in a wall of the housing to permit air to enter the housing. The second port is positioned relative to the air filter on a side opposite from the first port. A valve assembly is pivotably mounted within the second port such that the valve assembly is positionable to control a flow of air through the second port. Means are provided for controlling the pivoting of the valve assembly.

The air cleaner of the present invention facilitates varying engine performance by controlling the amount of air flowing into the carburetor. The present invention permits the rate of air flowing into the air cleaner and carburetor to be changed as a function of a vacuum supplied from the internal combustion engine.

In a preferred embodiment, a third port is formed within a wall of the housing to permit air to enter and exit the housing. The third port is positioned relative to the air filter on a side opposite from the first port. The third port is located at a point closer to the air filter than the second port. This third port aids in balancing the air flow into and out of the air filter to manage the balance of air entering the mouth of the carburetor and exiting a venting channel of the carburetor.

The means for positioning the valve assembly is a rod having one end connected to the valve assembly and another end connected to a diaphragm of a vacuum chamber. A spring of the vacuum chamber biases the rod to keep the valve assembly in an open position when no vacuum is being applied and in a closed position when a vacuum is drawing on the diaphragm.

In a variation of the preferred embodiment, the third port is closed to further accentuate the increased flow of air being forced into the carburetor by the present invention. In accordance with this embodiment, appropriate modifications of the carburetor and other systems of the engine must be made to permit the air cleaner to facilitate the increased air flow into the carburetor without simultaneously upsetting the proper balance of the air flow entering and exiting the carburetor.

While the above-identified drawing figures set forth several preferred embodiments, other embodiments of the present invention are also contemplated. In all cases, this disclosure presents illustrated embodiments of the present invention by way of representation and not limitation. Numerous other modifications and embodiments can be devised by those skilled in the art which fall within the scope and spirit of the principles of this invention. For instance, the sizes and shapes of the illustrated preferred embodiments are merely exemplary and are not the only sizes and shapes which embody the present invention. In particular, a side port opening in a housing of the air cleaner may be shaped other than a longitudinal slot. Also, some of the figures have been drawn not to scale to facilitate enlarging certain portions for clarity.

DETAILED DESCRIPTION OF THE PREFERRED EMBODIMENTS

Figure 1:
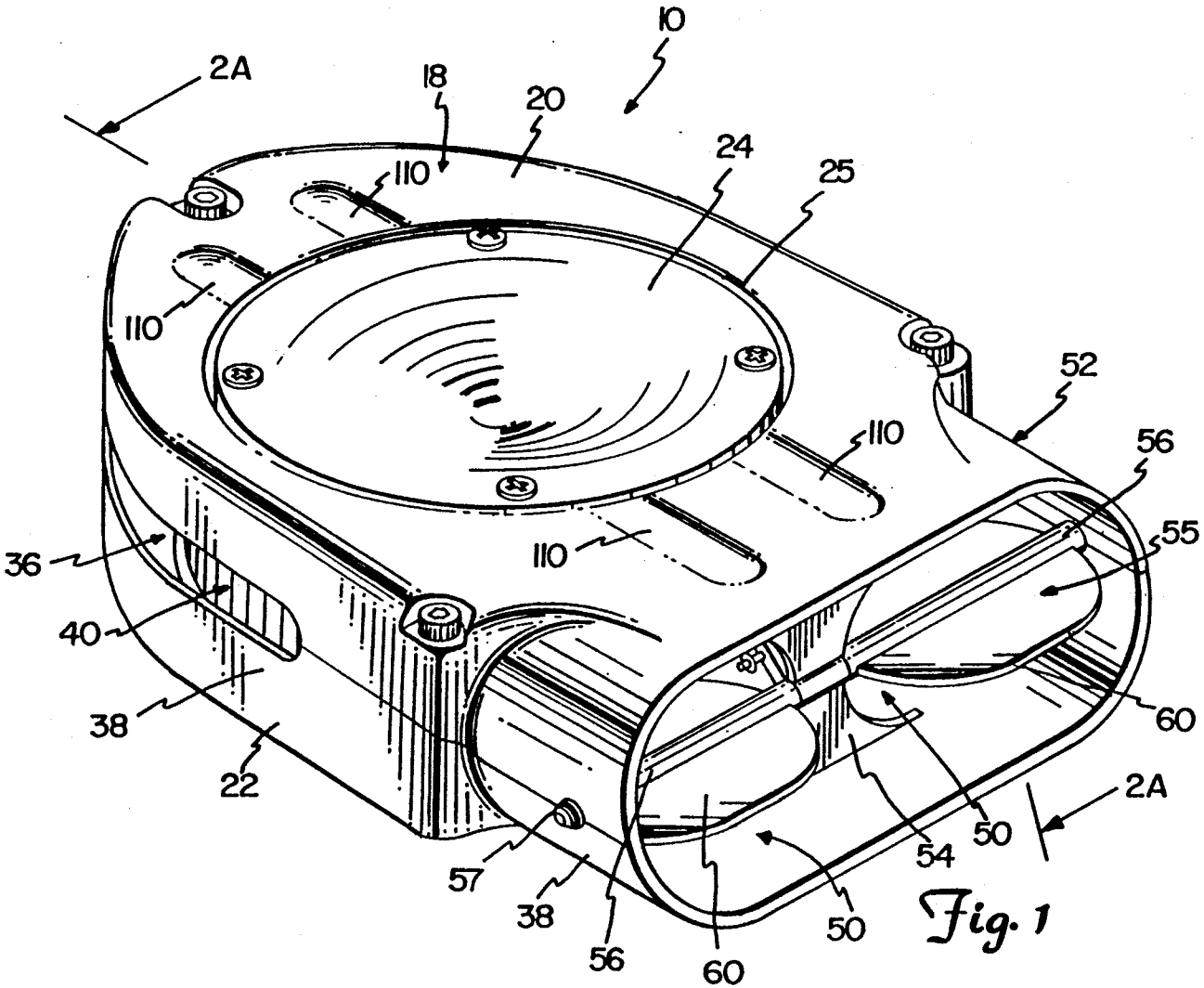
FIG. 1 is a perspective view of the air cleaner of the present invention with a valve assembly in the open position.
Figures 2A, 2B:
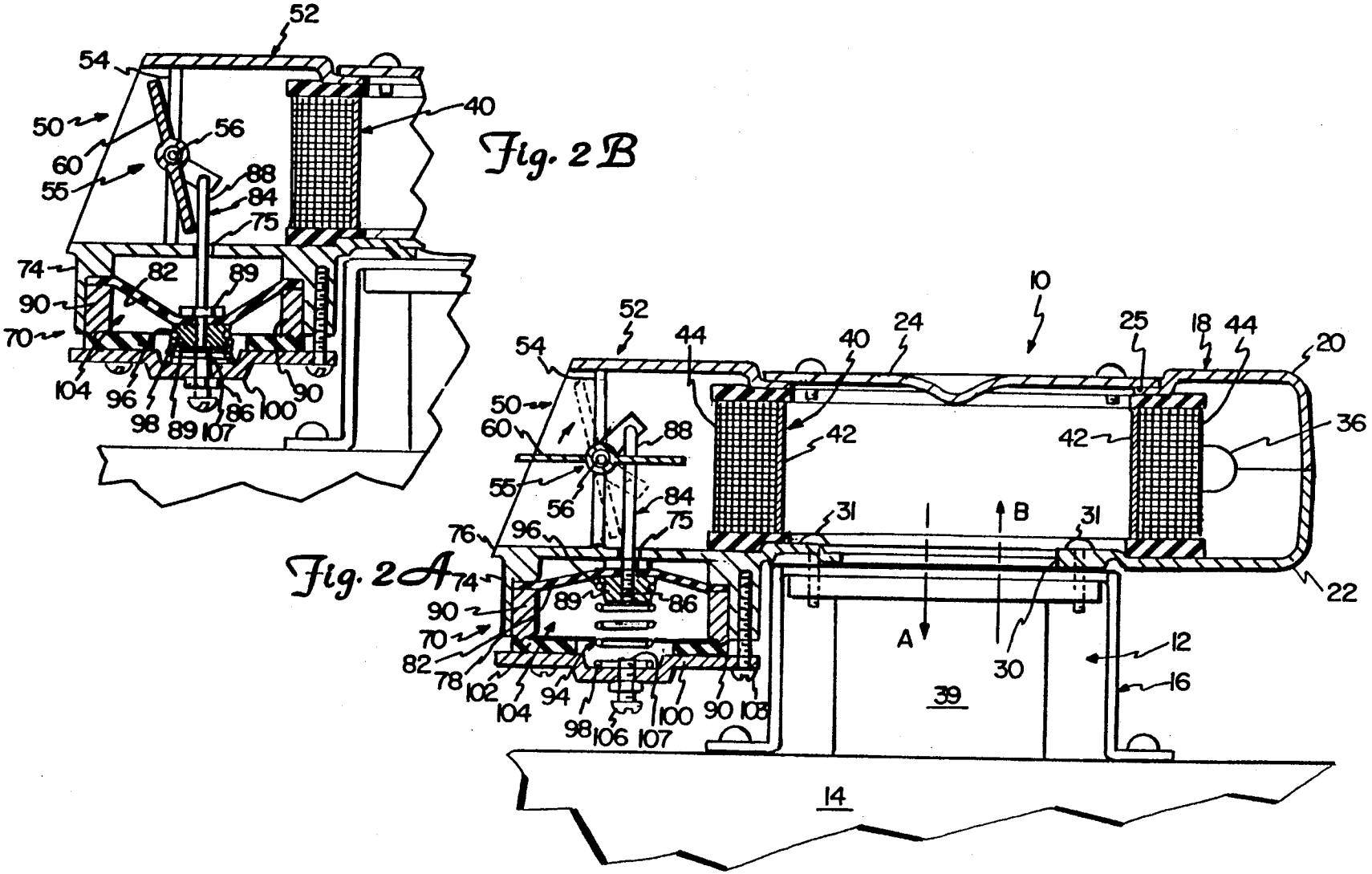
FIG. 2A is sectional view along line 2A—2A of FIG. 1 illustrating an air cleaner of the present invention as implemented with a carburetor of an internal combustion engine.
FIG. 2B is a fragmentary detail of the view shown in FIG. 2A except with a diaphragm shown in a position caused by a vacuum.

An air cleaner of the present invention is illustrated generally at 10 in FIGS. 1 and 2A. The air cleaner 10 is mounted onto a carburetor 12 of an internal combustion engine 14 of a motorcycle by use of a bracket 16 (see also FIG. 5).

Figure 3:
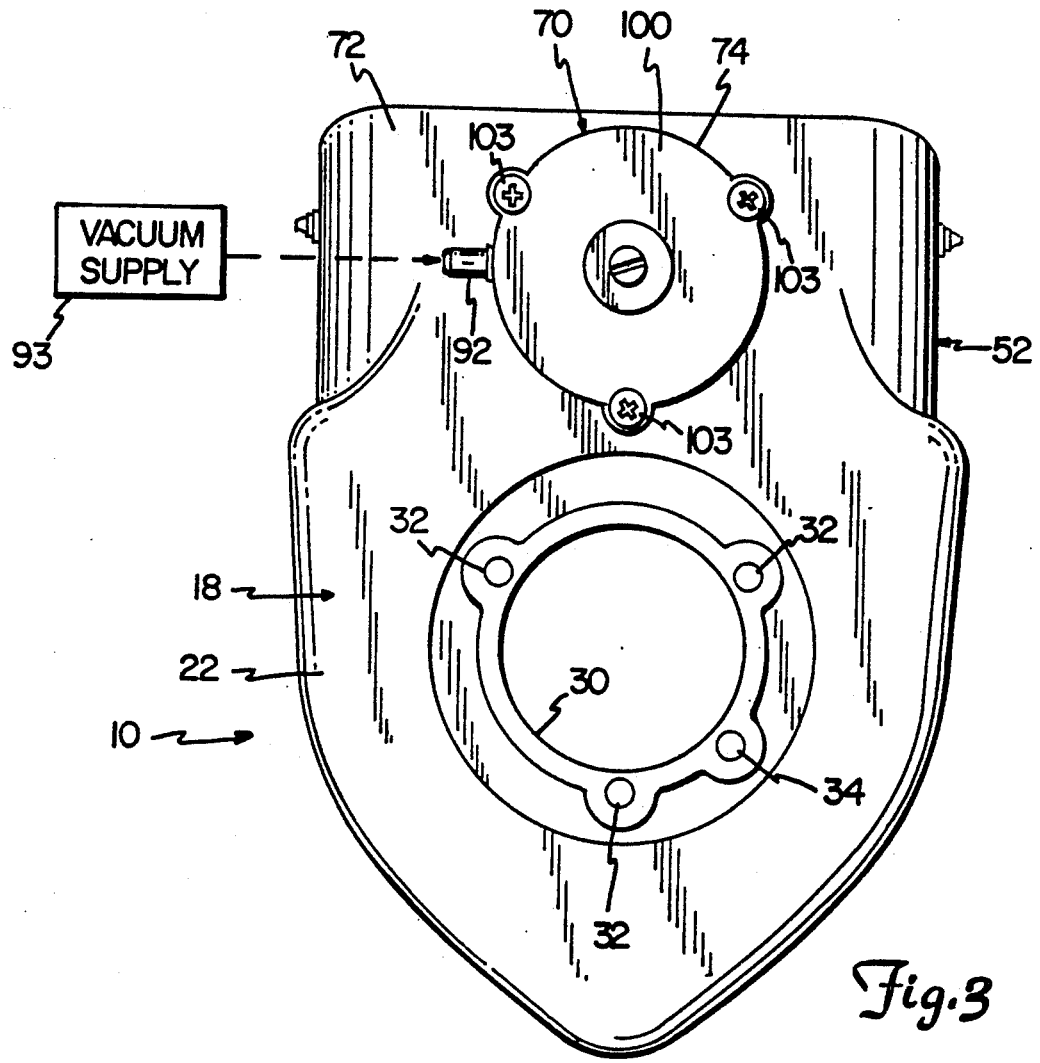
FIG. 3 is a plan view of a side of the air cleaner for facing the carburetor.
Figure 4:
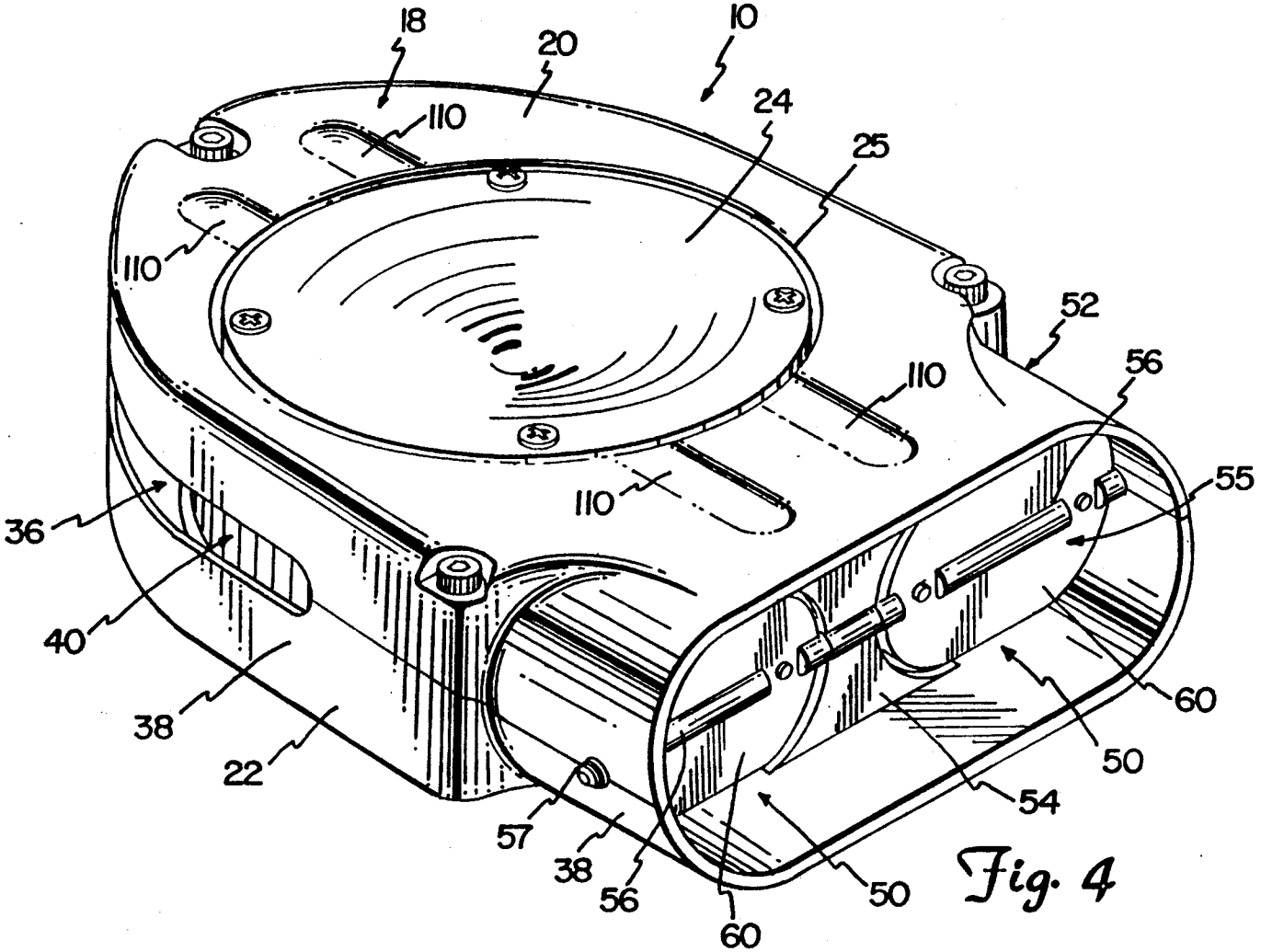
FIG. 4 is a perspective view of the air cleaner of FIG. 2 with the valve assembly in a closed position.

As seen in FIGS. 2A and 3, the air cleaner 10 has a housing 18 having a first portion 20 and a second portion 22. The housing 18 is preferably made of a chrome plated steel. A circularly-shaped air deflection plate 24 is secured within an opening 25 in a wall of the first portion 20. A circularly-shaped port opening 30 is formed in a wall of the second portion 22 of housing 18. The second portion 22 also has a plurality of openings 32 disposed about the port 30 for use with a fastener means 31 (FIG. 2A) to secure the housing 18 to the bracket 16 and carburetor 12. In addition, a carburetor vent port opening 34 is positioned about the port 30 and is shaped similar to openings 32. As seen in FIGS. 1 and 4, a longitudinally shaped slot port opening 36 is formed in a side wall 38 of housing 18. Alternatively, the port opening 36 can be formed by a plurality of circularly shaped openings or differently shaped openings sufficient to allow air to enter the housing 18 and to allow water (or other liquid) to escape the housing 18 through port 36.

As seen in FIG. 2A, the first port 30 provides a path (indicated by arrow A) for fluid communication from the housing 18 into a mouth 39 of carburetor 12. Similarly, the vent port 34 provides a path for fluid communication in a direction opposite from path A (indicated by arrow B) from a vent channel (not shown) of the carburetor 12 into the housing 18.

An air filter 40 is contained within the housing 18 of air cleaner 10. The air filter 40 is annularly shaped and has an inner wall 42 and an outer wall 44. A radius of the inner wall 42 of filter 40 is greater than a radius of the first port 30.

As seen in FIGS. 1 and 2A, a main port opening 50 is formed in a mouth portion 52 of the housing 18. The mouth portion 52 includes a stem 54 that separates the port opening 50 into two portions. A valve assembly 55 is disposed within the mouth portion 52 of housing 18. The valve assembly 55 includes a pivoting rod 56 and a pair of valve plates 60. The pivoting rod 56 extends a width of the mouth portion 52 and is pivotally mounted through stem 54 and the side wall 38 of housing 18. A pair of rings 57 (only one shown) are respectively mounted about each end of the pivoting rod 56 to facilitate rotation of the rod 56 relative to the side wall 38.

The pair of ventilation valve plates 60 are generally oval shaped and are connected to the pivoting rod 56 such that one of each of the valve plates 60 is positioned within one of the two openings of the main port 50. The generally oval shape of the valve plates 60 closely fits within the shape of the two main port openings 50 such that a close tolerance is maintained between an edge of the plates 60 and an edge of the main port openings 50. Alternatively, the valve plates 60 can be circularly shaped or rectangularly shaped with the main port openings 50 accordingly shaped to accommodate the shape of the valve plates 60 while still maintaining the close tolerance.

Figure 5:
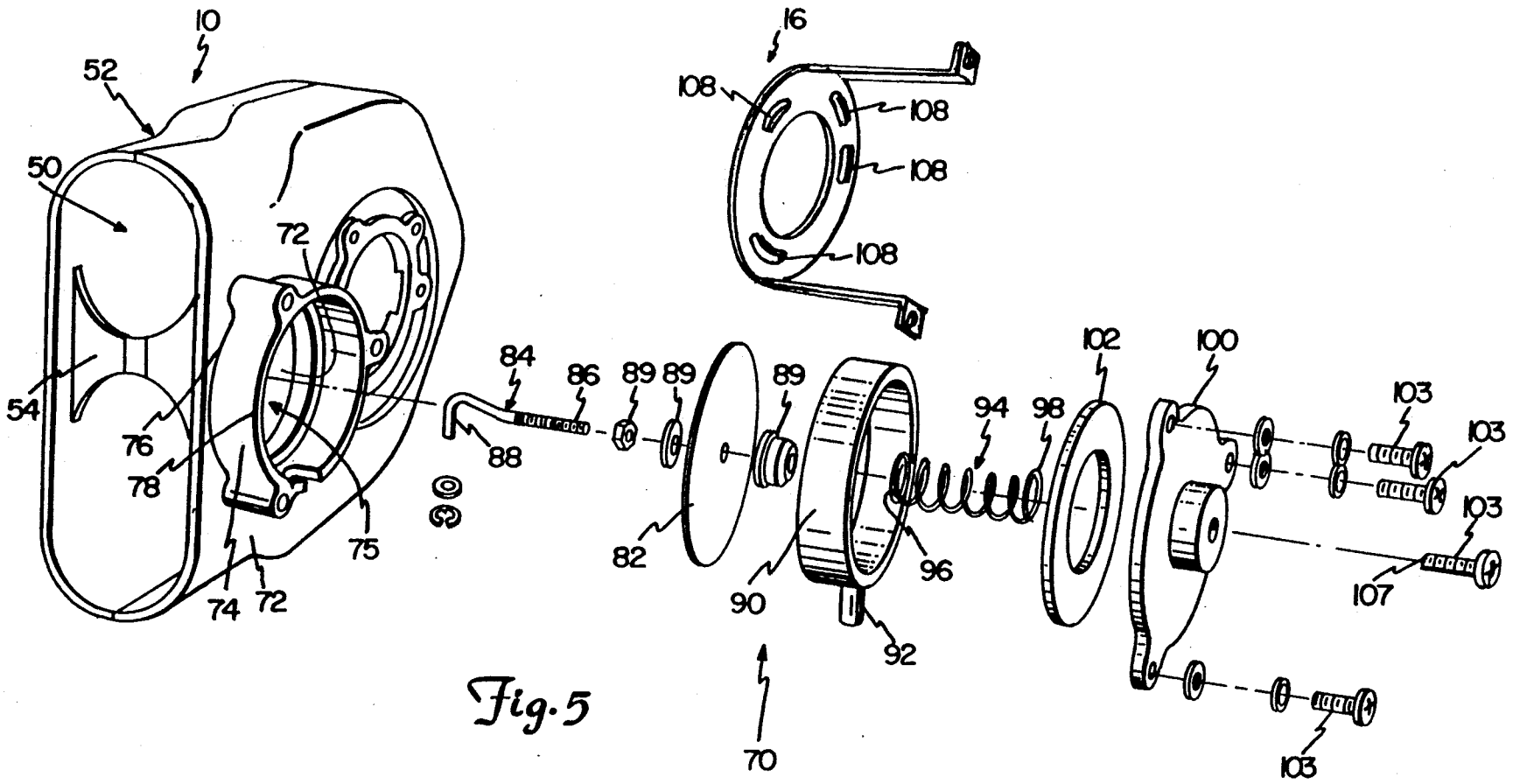
FIG. 5 is a perspective view of the air cleaner with the diaphragm assembly shown in a exploded view.

As seen in FIGS. 2A, 3 and 5, a diaphragm assembly 70 of the air cleaner 10 is disposed on an outer wall 72 of the second portion 22 of housing 18. The diaphragm assembly 70 includes a cylinder 74 extending outwardly from the outer wall 72. The cylinder 74 has a first end 76 and second end 78 with the first end encompassing a circularly shaped opening 75 formed in the outer wall 72 of the housing 18. A flexible round diaphragm 82 is secured within the first end 76 of the cylinder 74 to cover the opening 75. The diaphragm 82 is preferably made of a soft flexible rubber material.

A rod 84 of the diaphragm assembly 70 has a first end 86 and a second end 88. The first end 86 of the rod 84 extends through the opening 75 and a center of the diaphragm 82 and is connected thereto by a suitable fastening means such as multipart fastener 89. The second end 88 of the rod 84 extends in the opposite direction into the mouth portion 52 of the housing 18. The second end 88 of the rod 84 is bent relative to the first end 86 and is connected to the pivoting rod 56 at a midway point between the two valve plates 60. The rod 84 is aligned with the stem 54 so that the rod is not readily visible from outside the mouth portion 52 of housing 18 (FIG. 1).

A vacuum sealing ring 90 of the diaphragm assembly 70 is disposed within the cylinder 70 and is positioned over the diaphragm 82. The ring 90 has a stem valve 92 (FIGS. 3 and 5) for connecting the ring 90 to a vacuum supply 93 (schematically illustrated in FIG. 3) of the internal combustion engine 14. The vacuum supply 93 can be provided from a vacuum chamber in the carburetor (not shown) or from some other suitable vacuum system of the internal combustion engine 14.

A coil spring 94 of the diaphragm assembly 70 (FIGS. 2A, 2B, and 5) has a first end 96 secured to the fastener 89. A second end 98 of the spring 94 is constrained by a cover 100. The cover 100 includes a sealing gasket 102 and is secured onto the second end 78 of cylinder 74 by a suitable fastening means such as fasteners 103 to create a sealed chamber 104 therein. The sealing gasket 102 is preferably made of a hard rubber material. The cover 100 also includes an adjustment screw 106 has an end 107 which extends into the sealed chamber 104 to contact fastener 89 (see FIG. 2B). In a variation of the preferred embodiment, the cover 100, sealing gasket 102, and cylinder 74 can be integrally connected to simplify the construction of some of the components forming the diaphragm assembly 70.

The air cleaner 10 is normally oriented relative to the engine 16 so that the main port 50 faces the direction in which the motorcycle moves. In this orientation, the pivoting rod 56 is aligned vertically relative to the ground (a horizontal axis). This orientation provides a direct path for air flowing along side a moving motorcycle to enter the air cleaner 10 and flow into the air filter 10. In addition, as seen in FIG. 5, the bracket 16 has a plurality of elongate slots 108 for mounting the air cleaner 10 thereon. The elongation of the slots permits the housing 18 of air cleaner 10 to be rotated slightly upward or downward relative to its normal position when fastened to the bracket 16 such that the main port 50 would respectively be facing slightly upward or downward relative to the ground.

When mounted to an internal combustion engine 14, the air cleaner 10 provides an effective and aesthetically pleasing air intake mechanism for a carburetor 12. The air cleaner 10 filters air before it flows into the carburetor for mixing with fuel. For each state of the engine (starting, idling, or full/half throttle), the air takes a different path into the air cleaner 10 depending upon whether the valve plates 60 are in an open position (FIG. 1 and 2A), or in a closed position (FIG. 4), or in a partially open/closed position (FIG. 2B).

The position of the valve plates 60 is dictated by operation of the diaphragm assembly 70. The diaphragm assembly is controlled by the vacuum supply 93 which selectively applies a vacuum on the diaphragm assembly 70. As seen in FIG. 2A, when no vacuum is present, the spring 94 is biased to maintain the diaphragm 82 and rod 84 in the position shown in FIGS. 1 and 2A, i.e., maintaining the valve plates 60 in an open position. This allows air to flow through the main port openings 50 of the mouth portion 52 of housing 18.

As seen in FIG. 2B, when a vacuum is applied, the pressure of the vacuum pulls the diaphragm 82 towards the cover 100 overcoming the force (bias) of the spring 94 to move the first end 86 of the rod 84 (with the diaphragm 82) toward the cover 100. Moving the rod in this direction causes the valve plates 60 to rotate toward a closed position (see FIGS. 2B and 4) in which the plates 60 occlude the main port openings 50 thereby preventing air from entering the air cleaner through main port 50.

When starting the engine, no vacuum is present on the diaphragm assembly 70 such that the valve plates 60 of mouth portion 52 are in an open position (FIG. 1) permitting air to flow in through the main port 50 of the air cleaner 10. The air then flows into and through the air filter 40, through port opening 30, and down into the mouth 39 of carburetor 12. The slot port 36 provides an exhaust port for excess air flowing in the housing 18 to exit so that the appropriate flow rate of air enters the carburetor 12 without over pressurizing the carburetor 12. In addition, the vent port 34 permits air to exit the carburetor through carburetor vent channel (not shown) and into the housing 18 (the path indicated by arrow B). In combination, the main port 50, slot port 36, port 30 and carburetor vent port 34 maintain an appropriately balanced air flow into the mouth 39 of carburetor 12.

When idling the engine, a vacuum is present on the diaphragm assembly 70 such that the valve plates 60 are in a substantially closed position (see FIG. 2B), or in a fully closed position (FIG. 4). This reduces the air flow entering the air cleaner 10 through the main port openings 50. Instead, air must enter the air cleaner 10 through slot port 36. The air travels through the slot port 36 into and though the air filter 40, through port 30 and into the mouth 39 of the carburetor 12. Venting of the carburetor is provided by vent carburetor port 34 and a carburetor vent channel (not shown).

When operating the engine 14 at full throttle, no significant vacuum is exerted on the diaphragm assembly 70 such that the air cleaner 10 operates in same manner as when the engine 14 is being started. The valve plates 60 are in an open position (FIG. 2) allowing air to enter the main port openings 50.

Of course, when the engine is being operated at less than full throttle (e.g. half throttle), a partial vacuum is being applied to the diaphragm assembly 70. In this instance, the diaphragm 82 is pulled toward the cover 100 to a lesser extent than when starting the engine such that the rod 84 causes the ventilation plates 60 to rotate into a partially open position (not shown). In this mode, more air is permitted to enter the main port openings 50 than when the plates are fully in the open position. By varying the amount of vacuum applied to the diaphragm assembly 70, the valve plates 60 may be oriented in a range of partially open/closed positions between the extremes of the open position (no vacuum) and the closed position (full vacuum).

The range of open/closed positions can also be controlled by use of the adjustment screw 106. By positioning the end 107 of the screw 106 further within the sealed chamber 104, the valve assembly 55 will be prevented from reaching the fully closed position (illustrated in FIG. 4) but instead will reach a position similar to that shown in FIG. 2B. The end 107 of the screw 106 acts a stop to prevent the fastener 89 (and the diaphragm 82) from moving any closer to the cover 100. This ultimately limits the extent to which the valve assembly 55 is permitted to rotate toward a closed position.

The operation of the valve assembly 55 (and diaphragm assembly 70) is not mechanically linked to the throttle control of the engine 14 but is controlled by a vacuum supplied by the vacuum supply 93 and which acts on the diaphragm assembly 70. In a variation of the preferred embodiment, a throttle control can be used to control the operation of the valve assembly 55 by establishing a mechanical linkage between the throttle control and the valve assembly 55.

However, using the vacuum control diaphragm assembly 70 to control the positioning of the valve plates 60 has distinct advantages over a mechanically based throttle control. First, using a vacuum control avoids placing an additional load on the throttle cable. This provides an important ergonomic benefit of preventing fatigue on the arm/wrist of the motorcycle operator that would occur if the throttle cable were loaded with an additional linkage to control the valve assembly 55. This additional linkage also would be more likely to require maintenance. More importantly, using a vacuum control establishes a more direct relationship between the demand for air by the engine and the appropriate positioning of the valve assembly 55 than with a mechanical throttle control.

The air cleaner 10 of the present invention facilitates varying engine performance by controlling the amount of air flowing into the carburetor 12. A motorcycle having an internal combustion engine with the air cleaner 10 of the present invention and moving at a fast speed, i.e., with full throttle (no vacuum), will realize a substantially increased amount of air flowing into the air filter 40 and carburetor 12.

Figure 6:
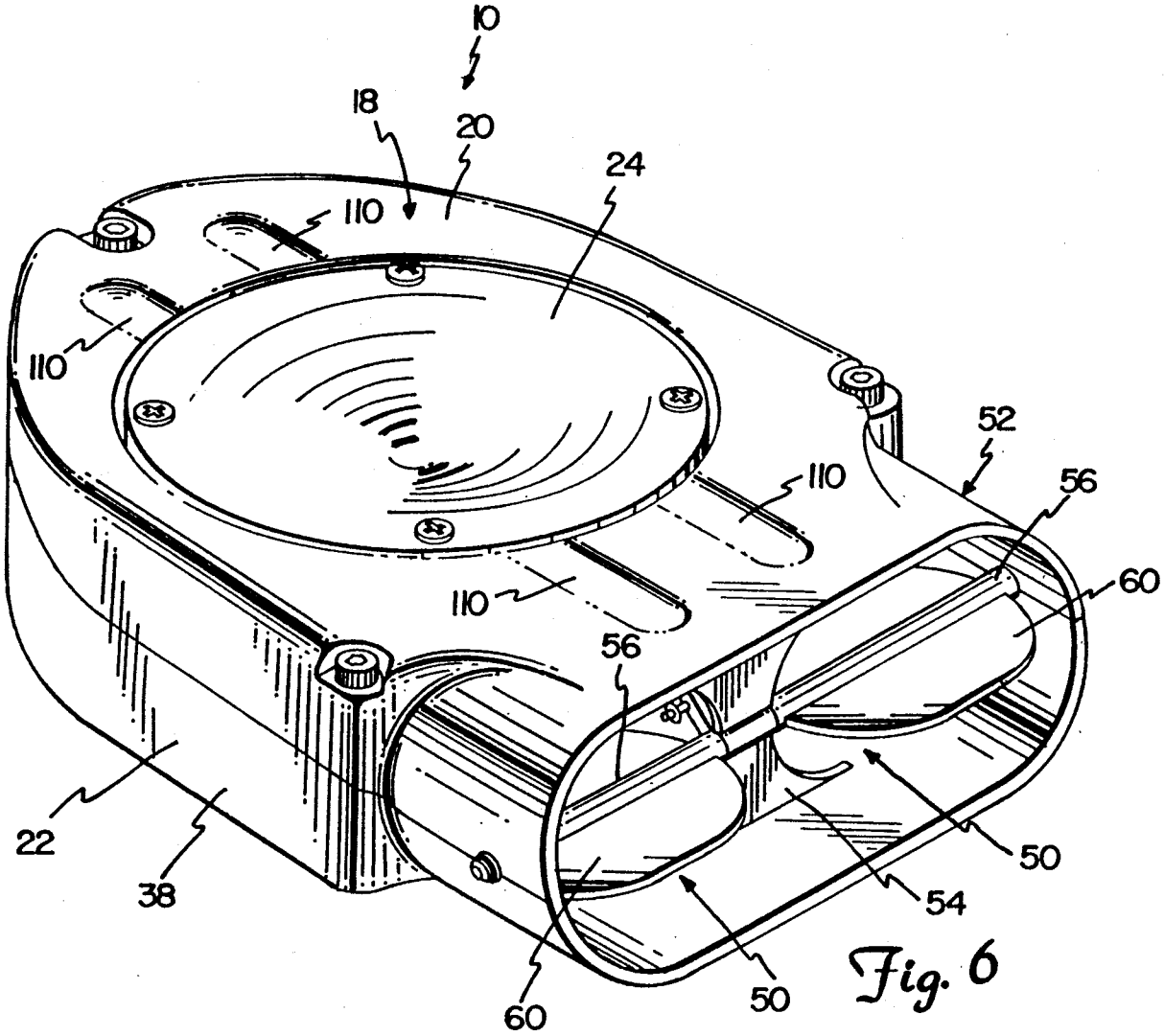
FIG. 6 is a perspective view of the air cleaner as in FIG. 1 except without a side port.

One can also make appropriate modifications of the carburetor 12 and other systems of the engine to further facilitate varying engine performance by increasing the amount of air flowing into the carburetor. For example, the air cleaner 10 can be modified as shown in FIG. 6. As shown, the slot port 36 has been eliminated. This forces more of the air entering the main port 50 to flow into the carburetor 12 than in the embodiment of the air cleaner 10 having the slot port 36. In using this modified form of the preferred embodiment, the vent port 34 and carburetor vent channel (not shown) also would be eliminated and some other venting means for the carburetor would be required to maintain the proper balance of air entering and exiting the carburetor 12. For example, a remotely located vent for a carburetor float chamber could be provided.

Many motorcycle owners augment the original equipment on their motorcycles and desire the added parts to contribute to the aesthetic appearance of the cycle. To that end, the air cleaner 10 of the present invention includes several features that accentuate the aesthetic appearance of the cycle. First, the housing 18 is chrome plated, offering a shiny look to the air cleaner 10. Second, the air deflection plate 24 is colored (e.g. red or blue) to match or compliment a primary color of the cycle. The valve plates 60 may be similarly colored to match the color of the air deflection plate 24. Finally, a pair of blood grooves 110 can be formed on an outer wall 72 of the housing 18 to provide a unique texture to the surface of the housing 18.

The air cleaner 10 of the present invention also offers other advantages. The air deflection plate 24 acts as an access cover for the housing 18. The plate 24 can be removed to expose the interior of the housing 18 so that one can access the mouth 39 of the carburetor 12 or the inner wall 42 of the air filter 40. This ability to access the interior of the housing 18 provides easy serviceability by permitting an operator to examine the air filter or add fluid to the carburetor, as well as perform any other necessary maintenance. Having a removable access cover plate 24 also provides access to the fastener openings 32 to permit the air cleaner 10 to be mounted to the carburetor 12 without disassembling the housing 18 into its two separate portions 20 and 22.

Another advantage of the air cleaner 10 of the present invention is the manner of mounting the diaphragm assembly 70 on the housing 18. The diaphragm assembly 70 is uniquely positioned on the outer wall 72 of second portion 22 of housing 18 so that the assembly 70 faces the engine 14. This accentuates the aesthetic appearance of the air cleaner 10 as seen by an observer looking at the first portion (20) side of the housing 18. More importantly, mounting the diaphragm assembly 70 in this way also permits the rod 84 to be centered between the two valve plates 60, thereby simplifying the rod linkage extending from the diaphragm 82 for controlling rotation of the ventilation plates 60. This provides a much simpler and efficient rod linkage than if the diaphragm assembly were mounted on the side wall 38 of the housing 18.

Although the present invention has been described with reference to preferred embodiments, workers skilled in the art will recognize that changes may be made in form and detail without departing from the spirit and scope of the invention.

What is claimed is:

1. An air intake assembly for delivering air to a carburetor of an internal combustion motorcycle engines, the assembly comprising:

a housing mountable on the carburetor and enclosing an air filter;

a first port formed in a wall of the housing to permit fluid communication between the housing and the carburetor, the first port being positioned between the air filter and the carburetor;

a second port formed in a wall of the housing to permit air to enter the housing, the second port being positioned relative to the air filter on a side opposite from the first port;

a valve assembly pivotably mounted within the second port; and means for positioning the valve assembly to control a flow of air through the second port.

2. The air intake assembly of claim 1 and further comprising:

a third port formed in a wall of the housing to permit air to enter and exit the housing via the third port, the third port being positioned relative to the air filter on a side opposite from the first port.

3. The air intake assembly of claim 2 wherein the third port is a longitudinally shaped slot.

4. The air intake assembly of claim 1 wherein the housing is defined by a first housing portion and a second housing portion connected to the first housing portion, wherein the first port is a circularly shaped opening formed in a wall of the second housing portion.

5. The air intake assembly of claim 4 wherein the first housing portion further comprises a circularly shaped opening formed in a wall of the first housing portion of the housing.

6. The air intake assembly of claim 5 and further comprising: a circularly shaped air deflection plate for covering the opening in the first housing portion of the housing, the plate being substantially planar with a contoured depression formed about a center of the plate.

7. The air intake assembly of claim 6 wherein the plate is selectively removable from the opening of the first housing portion for providing access to an interior of the housing through the opening of the first housing portion to facilitate mounting the housing to the carburetor.

8. The air intake system of claim 1 wherein the air filter is annularly shaped and has an inner wall extending about a circumference of the first port opening.

9. The air intake system of claim 8 wherein the second port of the housing is exterior to an outer wall of the air filter.

10. The air intake assembly of claim 1 wherein the valve assembly further comprises a pivot rod pivotably mounted within the second port and at least one plate secured on the rod.

11. The air intake assembly of claim 10 wherein the plate is substantially planar having a generally oval shape for reciprocating the shape of the second port.

12. The air intake assembly of claim 10 wherein the plate is mounted on the rod along with the longitudinal axis of the plate being substantially parallel to the longitudinal axis of the rod.

13. The air intake assembly of claim 10 wherein the valve assembly is pivotably movable to a closed position for preventing air flow through the second port and pivotably movable to other open positions for facilitating air flow through the second port.

14. The air intake assembly of claim 13 wherein the positioning means further comprises:

a sealed chamber having a flexible diaphragm portion in communication with an interior of the housing adjacent the second port;

a control rod having a first portion and a second portion, the first portion being cooperable with the diaphragm portion of the sealed chamber and extending within an interior of the sealed chamber, the second portion of the rod extending from the diaphragm portion through the interior of the housing and being connected to the pivot rod of the valve assembly;

vacuum means in communication with the sealed chamber for controlling selective movement of the diaphragm portion of the sealed chamber to cause pivoting of the valve assembly.

15. The air intake assembly of claim 14 wherein the sealed chamber further comprises:

a cylinder extending outwardly from an outer surface of the second portion of the housing, the cylinder having a first end and a second end, with the first end encompassing a fourth port circular opening formed in a wall of the second portion of the housing;

the diaphragm portion having a circular shape and being disposed within the fourth port opening;

a cover plate covering and secured over the second end of the cylinder; and sealing means for sealing an interior of the diaphragm portion, cylinder, and cover plate.

16. The air intake assembly of claim 15 wherein the positioning means further comprises a coil spring with a longitudinal axis of the spring aligned between the diaphragm and the cover plate, the control rod extending coaxially into an end of the coil spring.

17. The air intake assembly of claim 16 wherein the spring is biased to maintain the diaphragm portion and control rod in a position so that the valve assembly is one of the open positions.

18. The air intake assembly of claim 17 wherein a vacuum supplied by the vacuum means draws the diaphragm portion towards the cover plate to overcome the force of the spring and move the control rod toward the cover plate for causing the valve assembly to pivot into the closed position preventing flow through the second port.

19. The air intake assembly of claim 18 wherein the positioning means further comprises a set screw cooperable with the cover plate and having an end extending into the sealed chamber through the coil spring, the screw end being selectively positionable relative to the cover plate so that the end of the screw controls the extent of movement of the second end of the control rod towards the cover plate to limit the pivoting of the valve assembly into the closed position.

20. The air intake assembly of claim 1 and further comprising a bracket for mounting the housing to the carburetor, the bracket having a plurality elongate slots formed therein, the slots being cooperable with fasteners for securing the bracket and housing to the carburetor.

21. The air intake assembly of claim 1 wherein a venting port of the carburetor allows air flow between the housing and the carburetor.

22. The air intake assembly of claim 1 wherein the second port further comprises a stem extending vertically from one side of the port to another to divide the port into two portions.

23. The air intake system of claim 1 wherein the positioning means is free of any mechanical linkage to a throttle control of the engine and carburetor.

24. The air intake assembly of claim 15 wherein the vacuum means is a vacuum supplied by a vacuum system of the carburetor.

25. The air intake system of claim 1 wherein an outer surface the housing has grooves formed thereon.

26. An air intake assembly for delivering air to a carburetor of an internal combustion motorcycle engine, the assembly comprising:

a housing mountable on the carburetor and enclosing an air filter;

a first port formed in a wall of the housing to permit communication between the housing and the carburetor, the first port being positioned between the air filter and the carburetor;

a second port formed in a wall of the housing to permit air to enter the housing, the second port being positioned relative to the air filter on a side opposite from the first port;

a third port formed in a wall of the housing to permit air to enter and exit the housing;

a valve assembly pivotably mounted within the second port; and means for controlling the pivoting of the valve assembly to control a flow of air through the second port.

* * * * *